US010752975B2

(12) United States Patent
Takeda et al.

(10) Patent No.: US 10,752,975 B2
(45) Date of Patent: Aug. 25, 2020

(54) METHOD OF PRODUCING GALVANNEALED STEEL SHEET

(71) Applicant: JFE STEEL CORPORATION, Chiyoda-ku, Tokyo (JP)

(72) Inventors: Gentaro Takeda, Tokyo (JP); Masaru Miyake, Tokyo (JP); Yoichi Makimizu, Tokyo (JP); Yoshitsugu Suzuki, Tokyo (JP); Yoshikazu Suzuki, Tokyo (JP)

(73) Assignee: JFE STEEL CORPORATION, Chiyoda-ku, Tokyo (JP)

( * ) Notice: Subject to any disclaimer, the term of this patent is extended or adjusted under 35 U.S.C. 154(b) by 681 days.

(21) Appl. No.: 15/318,673

(22) PCT Filed: Jun. 5, 2015

(86) PCT No.: PCT/JP2015/002851
§ 371 (c)(1),
(2) Date: Dec. 14, 2016

(87) PCT Pub. No.: WO2016/006159
PCT Pub. Date: Jan. 14, 2016

(65) Prior Publication Data

US 2017/0130296 A1 May 11, 2017

(30) Foreign Application Priority Data

Jul. 7, 2014 (JP) ..... 2014-140012

(51) Int. Cl.
*C21D 9/56* (2006.01)
*C23C 2/02* (2006.01)
(Continued)

(52) U.S. Cl.
CPC ..... *C21D 9/561* (2013.01); *C21D 9/56* (2013.01); *C23C 2/02* (2013.01); *C23C 2/06* (2013.01);
(Continued)

(58) Field of Classification Search
None
See application file for complete search history.

(56) References Cited

U.S. PATENT DOCUMENTS 8,592,049 B2 11/2013 Honda et al.
9,309,586 B2 4/2016 Fushiwaki et al.
(Continued)

FOREIGN PATENT DOCUMENTS

CN 102369305 A 3/2012
DE 102012101018 B3 3/2013
(Continued)

OTHER PUBLICATIONS

Translation of JP 2009209397 (A) (Year: 2009).*
(Continued)

*Primary Examiner* — Colleen P Dunn
*Assistant Examiner* — Michael J Kachmarik
(74) *Attorney, Agent, or Firm* — Kenja IP Law PC

(57) ABSTRACT

A method of producing a galvannealed steel sheet includes: annealing a steel strip by conveying the steel strip through a heating zone including a direct fired furnace, a soaking zone, and a cooling zone in this order in an annealing furnace; hot-dip galvanizing the steel strip discharged from the cooling zone; and heat-alloying a galvanized coating formed on the steel strip. Mixed gas of humidified gas and dry gas is supplied into the soaking zone from at least one gas supply port located in a region of lower ½ of the soaking zone in a height direction so that a dew point measured in a region of upper ⅕ of the soaking zone in the height direction and a dew point measured in a region of lower ⅕ of the soaking zone in the height direction are both 20° C. or more and 0° C. or less.

4 Claims, 2 Drawing Sheets

(51) Int. Cl.

| | |
|---|---|
| ***C23C 2/06*** | (2006.01) |
| ***C23C 2/40*** | (2006.01) |
| ***C23C 2/28*** | (2006.01) |
| *C22C 38/04* | (2006.01) |
| *C22C 38/00* | (2006.01) |

(52) U.S. Cl.

CPC ..... *C23C 2/28* (2013.01); *C23C 2/40* (2013.01); *C22C 38/00* (2013.01); *C22C 38/04* (2013.01)

(56) References Cited

U.S. PATENT DOCUMENTS

| | | | | |
|---|---|---|---|---|
| 2009/0123651 | A1 | 5/2009 | Okada | |
| 2012/0186707 | A1* | 7/2012 | Hirasawa | C21D 8/0236 148/660 |
| 2013/0270724 | A1* | 10/2013 | Albro | B01F 3/04007 261/128 |
| 2015/0140217 | A1 | 5/2015 | Takahashi et al. | |
| 2015/0167113 | A1* | 6/2015 | Takahashi | C23C 2/02 118/68 |
| 2015/0345002 | A1 | 12/2015 | Blumenau et al. | |
| 2017/0130296 | A1* | 5/2017 | Takeda | C23C 2/02 |
| 2017/0137906 | A1 | 5/2017 | Fan et al. | |
| 2019/0276913 | A1 | 9/2019 | Kwak et al. | |

FOREIGN PATENT DOCUMENTS

| | | | | | |
|---|---|---|---|---|---|
| EP | 1936000 | A1 | | 6/2008 | |
| EP | 2415896 | A1 | | 2/2012 | |
| JP | S59200719 | A | | 11/1984 | |
| JP | 2008275185 | A | | 11/2008 | |
| JP | 2009209397 | | * | 9/2009 | C23C 2/06 |
| JP | 2009209397 | A | | 9/2009 | |
| JP | 2010202959 | A | | 9/2010 | |
| JP | 2013245361 | A | | 12/2013 | |
| JP | 2014001898 | A | | 1/2014 | |
| JP | 5655955 | B2 | * | 1/2015 | C23C 2/02 |
| KR | 1020080046241 | A | | 5/2008 | |
| WO | 2007043273 | A1 | | 4/2007 | |
| WO | 2013187039 | A1 | | 12/2013 | |

OTHER PUBLICATIONS

Machine Translation from EPO JP 2009209397, Suzuki, 2009 (Year: 2009).*

Walls, Furnace Controls, ASM Handbook, vol. 4B, Steel Heat Treating Technologies (Year: 2014).*

Aug. 18, 2015, International Search Report issued in the International Patent Application No. PCT/JP2015/002851.

Dec. 13, 2016, Office Action issued by the Japan Patent Office in the corresponding Japanese Patent Application No. 2014-140012 with English language concise statement of relevance.

May 2, 2017, Extended European Search Report issued by the European Patent Office in the corresponding European Patent Application No. 15818936.5.

May 8, 2018, Office Action issued by the State Intellectual Property Office in the corresponding Chinese Patent Application No. 201580037073.0 with English language Search Report.

Feb. 1, 2018, Office Action issued by the Korean Intellectual Property Office in the corresponding Korean Patent Application No. 10-2017-7000540 with English language Concise Statement of Relevance.

Nov. 7, 2019, Office Action issued by the United States Patent and Trademark Office in the U.S. Appl. No. 15/541,401.

* cited by examiner

METHOD OF PRODUCING GALVANNEALED STEEL SHEET

TECHNICAL FIELD

The disclosure relates to a method of producing a galvannealed steel sheet using a continuous hot-dip galvanizing device that includes: an annealing furnace in which a heating zone, a soaking zone, and a cooling zone are arranged in this order; a hot-dip galvanizing line adjacent to the cooling zone; and an alloying line adjacent to the hot-dip galvanizing line.

BACKGROUND

In recent years, the demand for high tensile strength steel sheets (high tensile strength steel materials) which contribute to more lightweight structures and the like is increasing in the fields of automobiles, household appliances, building products, etc. As high tensile strength steel sheets, for example, it is known that a steel sheet with favorable hole expandability can be produced by containing Si in steel, and a steel sheet with favorable ductility where retained austenite (γ) forms easily can be produced by containing Si or Al in steel.

However, in the case of producing a galvannealed steel sheet using, as a base material, a high tensile strength steel sheet containing a large amount of Si (particularly, 0.2 mass % or more), the following problem arises. The galvannealed steel sheet is produced by, after heat-annealing the steel sheet as the base material at a temperature of about 600° C. to 900° C. in a reducing atmosphere or a non-oxidizing atmosphere, hot-dip galvanizing the steel sheet and further heat-alloying the galvanized coating.

Here, Si in the steel is an oxidizable element, and is selectively oxidized in a typically used reducing atmosphere or non-oxidizing atmosphere and concentrated in the surface of the steel sheet to form an oxide. This oxide decreases wettability with molten zinc in the galvanizing process, and causes non-coating. With an increase of the Si concentration in the steel, wettability decreases rapidly and non-coating occurs frequently. Even in the case where non-coating does not occur, there is still a problem of poor coating adhesion. Besides, if Si in the steel is selectively oxidized and concentrated in the surface of the steel sheet, a significant alloying delay arises in the alloying process after the hot-dip galvanizing, leading to considerably lower productivity.

In view of such problems, for example, JP 2010-202959 A (PTL 1) describes the following method. With use of a direct fired furnace (DFF), the surface of a steel sheet is oxidized and then the steel sheet is annealed in a reducing atmosphere to internally oxidize Si and prevent Si from being concentrated in the surface of the steel sheet, thus improving the wettability and adhesion of the hot-dip galvanized coating. PTL 1 describes that the reducing annealing after heating may be performed by a conventional method (dew point: −30° C. to −40° C.).

WO2007/043273 A1 (PTL 2) describes the following technique. In a continuous annealing and hot-dip coating method that uses an annealing furnace having an upstream heating zone, a downstream heating zone, a soaking zone, and a cooling zone arranged in this order and a hot-dip molten bath, annealing is performed under the following conditions to internally oxidize Si and prevent Si from being concentrated in the surface of the steel sheet: heating or soaking the steel sheet at a steel sheet temperature in the range of at least 300° C. by indirect heating; setting the atmosphere inside the furnace in each zone to an atmosphere of 1 vol % to 10 vol % hydrogen with the balance being nitrogen and incidental impurities; setting the steel sheet end-point temperature during heating in the upstream heating zone to 550° C. or more and 750° C. or less and the dew point in the upstream heating zone to less than −25° C.; setting the dew point in the subsequent downstream heating zone and soaking zone to −30° C. or more and 0° C. or less; and setting the dew point in the cooling zone to less than −25° C. PTL 2 also describes humidifying mixed gas of nitrogen and hydrogen and introducing it into the downstream heating zone and/or the soaking zone.

JP 2009-209397 A (PTL 3) describes the following technique. While measuring the dew point of furnace gas, the supply and discharge positions of furnace gas are changed depending on the measurement to control the dew point of the gas in the reducing furnace to be in the range of more than −30° C. and 0° C. or less, thus preventing Si from being concentrated in the surface of the steel sheet. PTL 3 describes that the heating furnace may be any of a direct fired furnace (DFF), a non-oxidizing furnace (NOF), and a radiant tube, but a radiant tube is preferable as it produces significantly advantageous effects.

CITATION LIST

Patent Literatures

PTL 1: JP 2010-202959 A
PTL 2: WO2007/043273 A1
PTL 3: 2009-209397 A

SUMMARY

Technical Problem

However, with the method described in PTL 1, although the coating adhesion after the reduction is favorable, the amount of Si internally oxidized tends to be insufficient, and Si in the steel causes the alloying temperature to be higher than typical temperature by 30° C. to 50° C., as a result of which the tensile strength of the steel sheet decreases. If the oxidation amount is increased to ensure a sufficient amount of Si internally oxidized, oxide scale attaches to rolls in the annealing furnace, inducing pressing flaws, i.e. pick-up defects, in the steel sheet. The means for simply increasing the oxidation amount is therefore not applicable.

With the method described in PTL 2, since the heating or soaking in the upstream heating zone, downstream heating zone, and soaking zone is performed by indirect heating, the oxidation of the surface of the steel sheet like that by direct firing in PTL 1 is unlikely to occur, and the internal oxidation of Si is insufficient as compared with PTL 1. The problem of an increase in alloying temperature is therefore more serious. Moreover, not only the amount of moisture brought into the furnace varies depending on the external air temperature change or the steel sheet type, but also the dew point of the mixed gas tends to vary depending on the external air temperature change, making it difficult to stably control the dew point in the optimal dew point range. Due to such large dew point variation, surface defects such as non-coating occur even within the aforementioned dew point ranges and temperature ranges. The production of stable products is therefore difficult.

With the method described in PTL 3, although the use of a DFF in the heating furnace may enable the oxidation of the surface of the steel sheet, stably controlling the dew point in a high dew point range of −20° C. to 0° C. in the aforementioned control range is difficult because humidified gas is not actively supplied to the annealing furnace. Besides, in the case where the dew point increases, the dew point in the upper part of the furnace tends to be high. For example, while a dew point meter in the lower part of the furnace indicates 0° C., the atmosphere in the upper part of the furnace has a high dew point of +10° C. or more. Operating the furnace in such a state for a long time has been found to cause pick-up defects.

It could therefore be helpful to provide a method of producing a galvannealed steel sheet whereby favorable coating appearance can be obtained with high coating adhesion even in the case of galvannealing a steel strip whose Si content is 0.2 mass % or more, and a decrease in tensile strength can be prevented by lowering the alloying temperature.

Solution to Problem

The disclosed technique suppresses the concentration of Si in the surface and lowers the alloying temperature by sufficiently oxidizing the surface of the steel sheet by use of a direct fired furnace (DFF) in the heating zone and then sufficiently internally oxidizing Si with the whole soaking zone being set to a dew point higher than that in conventional methods.

We provide the following:

[1] A method of producing a galvannealed steel sheet using a continuous hot-dip galvanizing device that includes: an annealing furnace in which a heating zone including a direct fired furnace, a soaking zone, and a cooling zone are arranged in the stated order; a hot-dip galvanizing line adjacent to the cooling zone; and an alloying line adjacent to the hot-dip galvanizing line, the method including: annealing a steel strip by conveying the steel strip through the heating zone, the soaking zone, and the cooling zone in the stated order in the annealing furnace; applying a hot-dip galvanized coating onto the steel strip discharged from the cooling zone, using the hot-dip galvanizing line; and heat-alloying the galvanized coating applied on the steel strip, using the alloying line, wherein reducing gas or non-oxidizing gas is supplied into the soaking zone, the reducing gas or the non-oxidizing gas is mixed gas obtained by mixing gas humidified by a humidifying device and dry gas not humidified by the humidifying device at a predetermined mixture ratio, and the mixed gas is supplied into the soaking zone from at least one gas supply port located in a region of lower ½ of the soaking zone in a height direction so that a dew point measured in a region of upper ⅕ of the soaking zone in the height direction and a dew point measured in a region of lower ⅕ of the soaking zone in the height direction are both −20° C. or more and 0° C. or less.

[2] The method of producing a galvannealed steel sheet according to the foregoing [1], wherein the at least one gas supply port includes a plurality of gas supply ports, and at least one of the gas supply ports is located at each of two or more different height positions.

[3] The method of producing a galvannealed steel sheet according to the foregoing [2], wherein a total gas flow rate from all gas supply ports located at a same height position is equal in all of the height positions, and the mixed gas supplied from a gas supply port lower in height position has a higher dew point.

[4] The method of producing a galvannealed steel sheet according to the foregoing [2], wherein a dew point of the mixed gas supplied from each of the gas supply ports is equal, and a gas flow rate from a gas supply port lower in height position is higher.

[5] The method of producing a galvannealed steel sheet according to any one of the foregoing [1] to [4], wherein a condition of supplying the mixed gas to the soaking zone satisfies the following Formula (1):

[Math. 1]

$$\left(2820-\frac{m_a-m_b}{y_a-y_b}y_i\right)\frac{Vt}{N}\le m_iV_i\le\left(12120-\frac{m_a-m_b}{y_a-y_b}y_i\right)\frac{Vt}{N} \quad (1)$$

where "V" is a flow rate of the mixed gas in $m^3$/hr, "m" is moisture content in the mixed gas calculated from a dew point of the mixed gas in ppm, "y" is a height position of a dew point meter or a gas supply port in m, "N" is a total number of the gas supply ports, subscript "t" is total mixed gas, subscript "a" is a dew point meter located in the region of upper ⅕ of the soaking zone in the height direction, subscript "b" is a dew point meter located in the region of lower ⅕ of the soaking zone in the height direction, and subscript "i" is an ith gas supply port.

[6] The method of producing a galvannealed steel sheet according to any one of the foregoing [1] to [5], wherein an oxidizing burner and a reducing burner situated downstream of the oxidizing burner in a steel sheet traveling direction are provided in the direct fired furnace, and an air ratio of the oxidizing burner is adjusted to 0.95 or more and 1.5 or less, and an air ratio of the reducing burner is adjusted to 0.5 or more and less than 0.95.

Advantageous Effect

It is thus possible to obtain favorable coating appearance with high coating adhesion even in the case of galvannealing a steel strip whose Si content is 0.2 mass % or more, and prevent a decrease in tensile strength by lowering the alloying temperature.

DETAILED DESCRIPTION (Continuous Hot-Dip Galvanizing Device 100)

Figure 1:
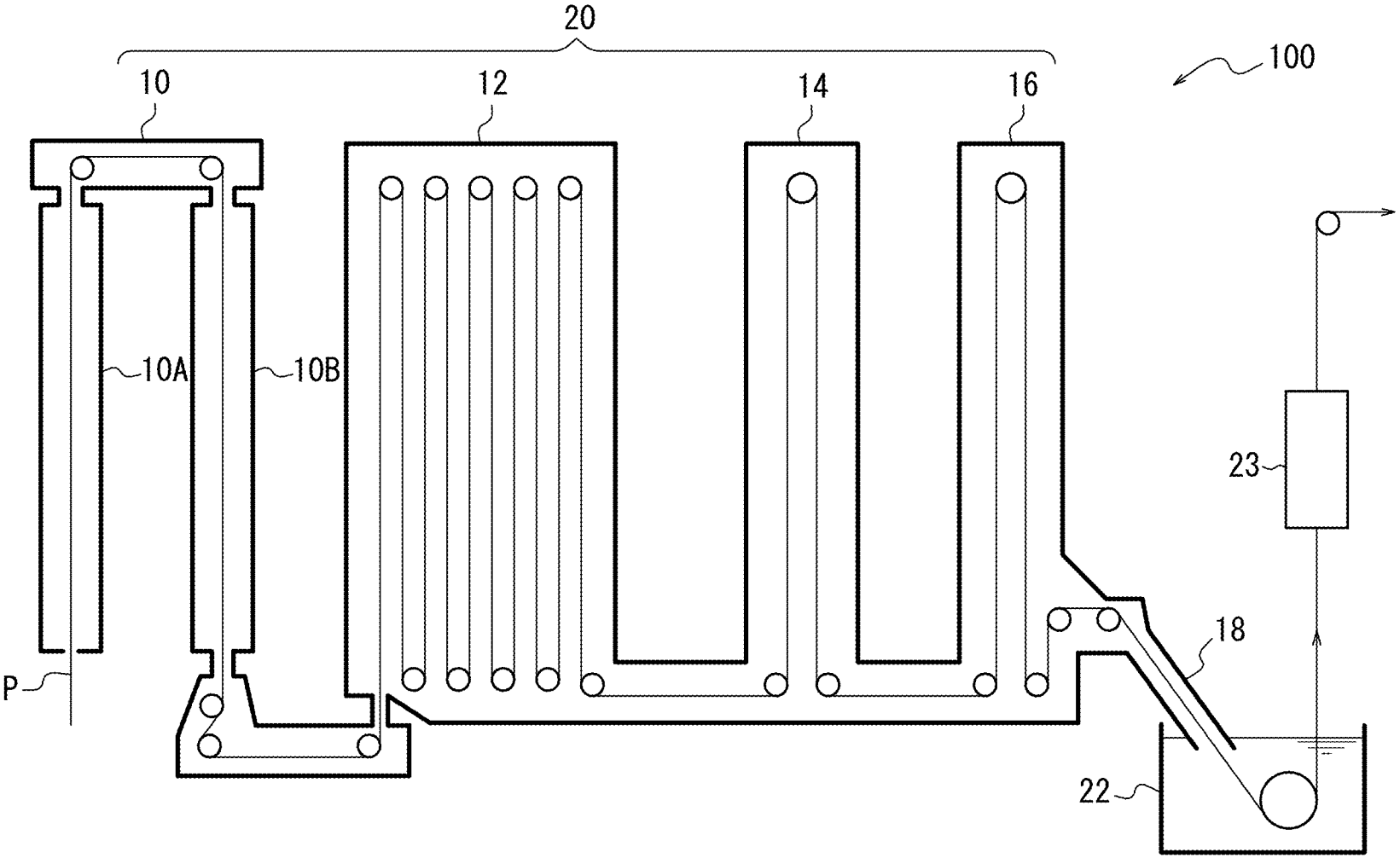
FIG. 1 is a sectional diagram illustrating the structure of a continuous hot-dip galvanizing device 100 used in a method of producing a galvannealed steel sheet according to one of the disclosed embodiments.

The structure of a continuous hot-dip galvanizing device 100 used in a method of producing a galvannealed steel sheet according to one of the disclosed embodiments is described first, with reference to FIG. 1. The continuous hot-dip galvanizing device 100 includes: an annealing furnace 20 in which a heating zone 10, a soaking zone 12, and cooling zones 14 and 16 are arranged in this order; a hot-dip galvanizing bath 22 as a hot-dip galvanizing line adjacent to the cooling zone 16; and an alloying line 23 adjacent to the hot-dip galvanizing bath 22. In this embodiment, the heating zone 10 includes a first heating zone 10A (upstream heating zone) and a second heating zone 10B (downstream heating zone). The cooling zone includes a first cooling zone 14

(rapid cooling zone) and a second cooling zone 16 (slow cooling zone). A snout 18 connected to the second cooling zone 16 has its tip immersed in the hot-dip galvanizing bath 22, thus connecting the annealing furnace 20 and the hot-dip galvanizing bath 22.

A steel strip P is introduced from a steel strip introduction port in the lower part of the first heating zone 10A into the first heating zone 10A. One or more hearth rolls are arranged in the upper and lower parts in each of the zones 10, 12, 14, and 16. In the case where the steel strip P is folded back by 180 degrees at one or more hearth rolls, the steel strip P is conveyed vertically a plurality of times inside the corresponding predetermined zone, forming a plurality of passes. While FIG. 1 illustrates an example of having 10 passes in the soaking zone 12, 2 passes in the first cooling zone 14, and 2 passes in the second cooling zone 16, the numbers of passes are not limited to such, and may be set as appropriate depending on the processing condition. At some hearth rolls, the steel strip P is not folded back but changed in direction at the right angle to move to the next zone. The steel strip P is thus annealed in the annealing furnace 20 by being conveyed through the heating zone 10, the soaking zone 12, and the cooling zones 14 and 16 in this order.

Adjacent zones in the annealing furnace 20 communicate through a communication portion connecting the upper parts or lower parts of the respective zones. In this embodiment, the first heating zone 10A and the second heating zone 10B communicate through a throat (restriction portion) connecting the upper parts of the respective zones. The second heating zone 10B and the soaking zone 12 communicate through a throat connecting the lower parts of the respective zones. The soaking zone 12 and the first cooling zone 14 communicate through a throat connecting the lower parts of the respective zones. The first cooling zone 14 and the second cooling zone 16 communicate through a throat connecting the lower parts of the respective zones. The height of each throat may be set as appropriate. Given that the diameter of each hearth roll is about 1 m, the height of each throat is preferably set to 1.5 m or more. Meanwhile, the height of each communication portion is preferably as low as possible, to enhance the independence of the atmosphere in each zone.

(Heating Zone)

In this embodiment, the second heating zone 10B is a direct fired furnace (DFF). The DFF may be, for example, a well-known DFF as described in PTL 1. A plurality of burners are distributed in the inner wall of the direct fired furnace in the second heating zone 10B so as to face the steel strip P, although not illustrated in FIG. 1. Preferably, the plurality of burners are divided into a plurality of groups, and the combustion rate and the air ratio in each group are independently controllable. Combustion exhaust gas in the second heating zone 10B is supplied to the first heating zone 10A, and the steel strip P is preheated by the heat of the gas.

The combustion rate is a value obtained by dividing the amount of fuel gas actually introduced into a burner by the amount of fuel gas of the burner under its maximum combustion load. The combustion rate at the time of combustion by the burner under its maximum combustion load is 100%. When the combustion load is low, the burner cannot maintain a stable combustion state. Accordingly, the combustion rate is preferably adjusted to 30% or more.

The air ratio is a value obtained by dividing the amount of air actually introduced into a burner by the amount of air necessary for complete combustion of fuel gas. In this embodiment, the heating burners in the second heating zone 10B are divided into four groups (#1 to #4), and the three groups (#1 to #3) upstream in the steel sheet traveling direction are made up of oxidizing burners, and the last group (#4) is made up of reducing burners. The air ratio of the oxidizing burners and the air ratio of the reducing burners are independently controllable. The air ratio of the oxidizing burners is preferably adjusted to 0.95 or more and 1.5 or less. The air ratio of the reducing burners is preferably adjusted to 0.5 or more and less than 0.95. The temperature in the second heating zone 10B is preferably adjusted to 800° C. to 1200° C.

(Soaking Zone)

In this embodiment, the soaking zone 12 is capable of indirectly heating the steel strip P using a radiant tube (RT) (not illustrated) as heating means. The average temperature Tr (° C.) in the soaking zone 12 is preferably adjusted to 700° C. to 900° C.

Reducing gas or non-oxidizing gas is supplied to the soaking zone 12. As the reducing gas, $H_2$—$N_2$ mixed gas is typically used. An example is gas (dew point: about −60° C.) having a composition containing 1 vol % to 20 vol % $H_2$ with the balance being $N_2$ and incidental impurities. An example of the non-oxidizing gas is gas (dew point: about −60° C.) having a composition containing $N_2$ and incidental impurities.

In this embodiment, the reducing gas or non-oxidizing gas supplied to the soaking zone 12 is mixed gas obtained by mixing gas humidified by a humidifying device and dry gas not humidified by the humidifying device at a predetermined mixture ratio. The mixture ratio is adjusted so that the dew point is a desired value of −50° C. to 10° C.

Figure 2:
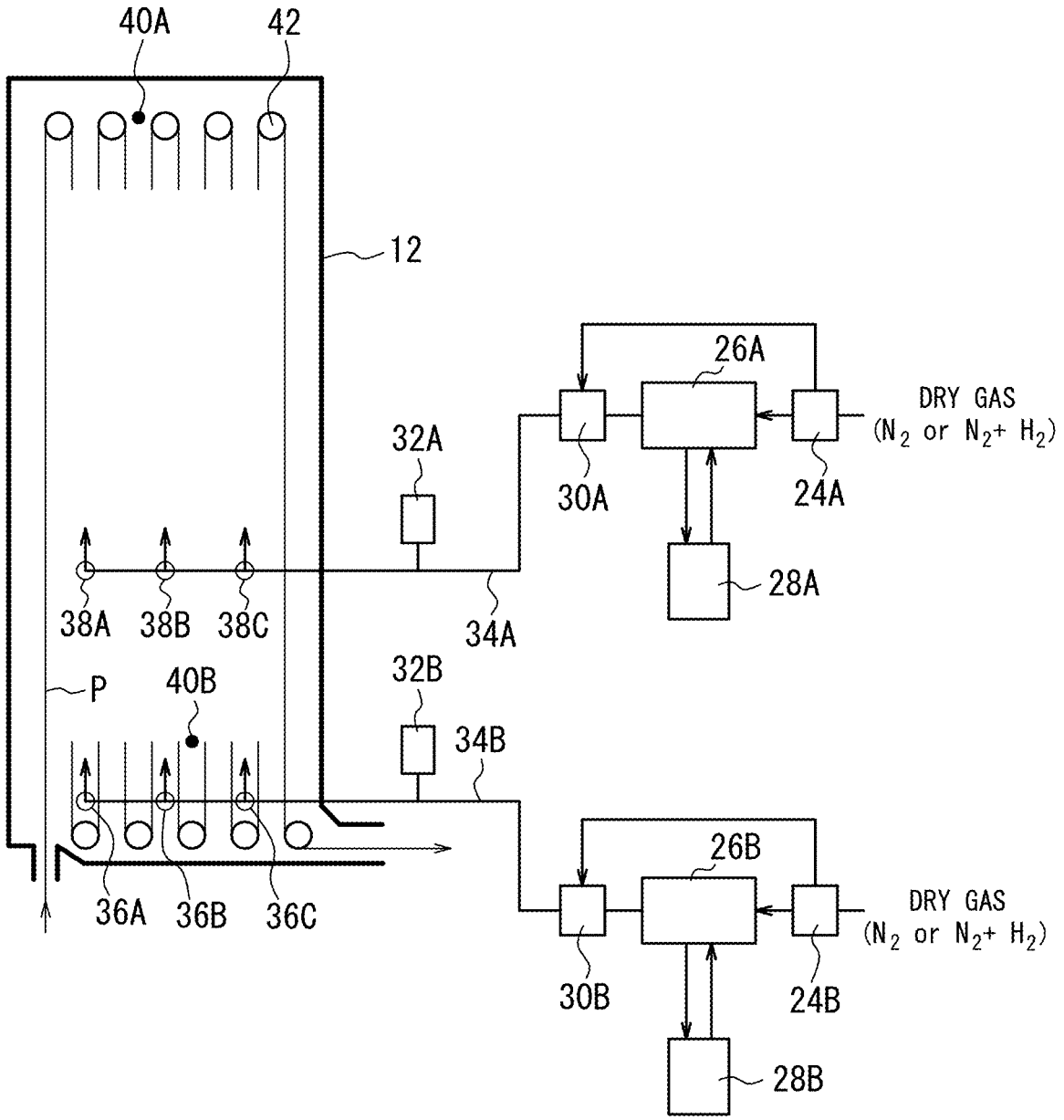
FIG. 2 is a schematic diagram illustrating a system of supplying mixed gas to a soaking zone 12 in FIG. 1.

FIG. 2 is a schematic diagram illustrating a system of supplying the mixed gas to the soaking zone 12. The mixed gas is supplied through two systems, namely, gas supply ports 36A, 36B, and 36C and gas supply ports 38A, 38B, and 38C. The system of the gas supply ports 38A, 38B, and 38C is described as an example below. A gas distribution device 24A feeds part of the aforementioned reducing gas or non-oxidizing gas (dry gas) to a humidifying device 26A and the remaining part to a gas mixing device 30A. The gas mixing device 30A mixes the gas humidified by the humidifying device 26A and the dry gas directly fed from the gas distribution device 24A at a predetermined ratio, to prepare mixed gas with a predetermined dew point. The prepared mixed gas passes through a mixed gas pipe 34A, and is supplied into the soaking zone 12 from the gas supply ports 38. Reference sign 32A is a mixed gas dew point meter. The system of the gas supply ports 36A, 36B, and 36C has the same structure.

The humidifying device 26 includes a humidifying module having a fluorine or polyimide hollow fiber membrane, flat membrane, or the like. Dry gas flows inside the membrane, whereas pure water adjusted to a predetermined temperature in a circulating constant-temperature water bath 28 circulates outside the membrane. The fluorine or polyimide hollow fiber membrane or flat membrane is a type of ion exchange membrane with affinity for water molecules. When moisture content differs between the inside and outside of the hollow fiber membrane, a force for equalizing the moisture content difference emerges and, with this force as a driving force, moisture transmits through the membrane and moves toward the part with lower moisture content. The temperature of dry gas varies with seasonal or daily air temperature change. In this humidifying device, however, heat exchange is possible by ensuring a sufficient contact area between gas and water through the vapor permeable membrane. Accordingly, regardless of whether the dry gas temperature is higher or lower than the circulating water temperature, the dry gas is humidified to the same dew point as the set water temperature, thus achieving highly accurate dew point control. The dew point of the humidified gas can be controlled to any value in the range of 5° C. to 50° C. When the dew point of the humidified gas is higher than the pipe temperature, there is a possibility that dew condensation occurs in the pipe and dew condensation water enters directly into the furnace. The humidified gas pipe is therefore heated/heat-retained to be not less than the dew point of the humidified gas and not less than the external air temperature.

By adjusting the gas mixture ratio in the gas mixing device 30, the mixed gas of any dew point can be supplied into the soaking zone 12. When the dew point in the soaking zone 12 is below the desired range, the mixed gas with a higher dew point is supplied. When the dew point in the soaking zone 12 exceeds the desired range, the mixed gas with a lower dew point is supplied.

(Cooling Zone)

In this embodiment, the cooling zones 14 and 16 cool the steel strip P. The steel strip P is cooled to about 480° C. to 530° C. in the first cooling zone 14, and cooled to about 470° C. to 500° C. in the second cooling zone 16.

The cooling zones 14 and 16 are also supplied with the aforementioned reducing gas or non-oxidizing gas. Here, only the dry gas is supplied. The gas flow rate Qcd of the dry gas supplied to the cooling zones 14 and 16 is about 200 to 1000 ($Nm^3$/hr).

(Hot-Dip Galvanizing Bath)

The hot-dip galvanizing bath 22 can be used to apply a hot-dip galvanized coating onto the steel strip P discharged from the second cooling zone 16. The hot-dip galvanizing may be performed according to a usual method.

(Alloying Line)

The alloying line 23 can be used to heat-alloy the galvanized coating applied on the steel strip P. The alloying treatment may be performed according to a usual method. In this embodiment, the alloying temperature is kept from being high, thus preventing a decrease in tensile strength of the produced galvannealed steel sheet.

(Method of Producing Galvannealed Steel Sheet)

One of the disclosed embodiments is a method of producing a galvannealed steel sheet using the continuous hot-dip galvanizing device 100. Gas in the annealing furnace 20 flows from downstream to upstream in the furnace. Normally, dry gas is supplied to each position in the annealing furnace so that the pressure in the furnace is a positive pressure in a predetermined range. This is because, if the pressure in the furnace decreases, external air enters into the annealing furnace and the oxygen concentration or dew point in the furnace increases, as a result of which the steel strip oxidizes and induces oxide scale or the hearth roll surface oxidizes and induces pick-up defects. On the other hand, if the pressure in the furnace increases excessively, the furnace itself may be damaged. The furnace pressure control is therefore very important for stable production.

We conducted keen examination on a dew point control method for stably controlling the dew point in the soaking zone 12 to −20° C. to 0° C. under such environment. As a result, we discovered that it is important to supply the aforementioned mixed gas into the soaking zone 12 from at least one gas supply port located in the region of lower ½ of the soaking zone 12 in the height direction. By introducing the mixed gas whose dew point is −10° C. to +10° C. from the region of lower half of the soaking zone 12, the dew point measured in the region of upper ⅕ of the soaking zone 12 in the height direction (for example, a dew point measurement position 40A in FIG. 2) and the dew point measured in the region of lower ⅕ of the soaking zone 12 in the height direction (for example, a dew point measurement position 40B in FIG. 2) can both be controlled to −20° C. or more and 0° C. or less.

We also discovered that the dew point in the soaking zone 12 can be stably controlled to −20° C. to 0° C. when the condition of supplying the mixed gas to the soaking zone 12 satisfies the following Formula (1):

[Math. 2]

$$\left(2820-\frac{m_a-m_b}{y_a-y_b}y_i\right)\frac{Vt}{N}\le m_iV_i\le\left(12120-\frac{m_a-m_b}{y_a-y_b}y_i\right)\frac{Vt}{N} \quad (1)$$

where "V" is the flow rate of the mixed gas ($m^3$/hr), "m" is the moisture content in the mixed gas calculated from the dew point of the mixed gas (ppm), "y" is the height position of a dew point meter or gas supply port (m), "N" is the total number of gas supply ports, subscript "t" is the total mixed gas, subscript "a" is a dew point meter located in the region of upper ⅕ of the soaking zone in the height direction, subscript "b" is a dew point meter located in the region of lower ⅕ of the soaking zone in the height direction, and subscript "i" is the ith gas supply port.

The moisture content m (ppm) can be calculated from the dew point of the mixed gas according to the following Formula (2):

[Math. 3]

$$m=6028.614\times10^{7.5T/(T+237.3)} \quad (2)$$

where T is the dew point (° C.).

The left side of Formula (1) represents the moisture content in the humidified gas to be sprayed depending on the height of the ith gas supply port (from among the plurality of gas supply ports), in consideration of the inclination of the upper and lower dew points in the furnace measured with respect to gas whose dew point is −10° C. The middle side of Formula (1) represents the moisture content in the gas from the ith gas supply port (from among the plurality of gas supply ports). The right side of Formula (1) represents the moisture content in the humidified gas to be sprayed depending on the height of the ith gas supply port (from among the plurality of gas supply ports), in consideration of the inclination of the upper and lower dew points in the furnace measured with respect to gas whose dew point is +10° C. We discovered that it is desirable to control the value of the middle side between the value of the left side and the value of the right side.

In detail, it is not preferable when $m_iV_i$ in the middle side of Formula (1) is less than the value of the left side, because the moisture content in the mixed gas is too low and humidifying performance is insufficient. It is also not preferable when $m_iV_i$ in the middle side of Formula (1) is more than the value of the right side, because the moisture content in the mixed gas is too high and humidifying performance is excessive, resulting in non-coating due to Fe surface oxidation or roll pick-up.

The flow rate V of the mixed gas is measured by a gas flowmeter (not illustrated) provided in the pipe. The moisture content m calculated from the dew point of the mixed gas is measured by a dew point meter. The dew point meter may be any of mirror surface type and capacitance type, and may be any other type. The average temperature Tr in the soaking zone 12 is measured by a thermocouple inserted into the soaking zone.

The conditions of the soaking zone 12 other than the above are not particularly limited, but are typically as follows: The volume Vr of the soaking zone 12 is 150 to 300 ($m^3$). The height of the soaking zone 12 is 20 to 30 (m). The total flow rate $V_t$ of the mixed gas supplied to the soaking zone 12 is set to about 100 to 400 ($Nm^3$/hr).

The mixed gas is preferably supplied to the soaking zone 12 from the plurality of gas supply ports located in the region of lower ½ of the soaking zone 12 in the height direction. In particular, the plurality of gas supply ports are preferably located at two or more different height positions, with two or more gas supply ports being situated at each height position, as illustrated in FIG. 2. More preferably, the plurality of gas supply ports are evenly distributed in the steel strip traveling direction.

More moisture is preferably supplied from a lower position in the soaking zone 12, to reduce the dew point deviation in the vertical direction of the soaking zone 12.

In one of the disclosed embodiments, the total gas flow from the gas supply ports located at the same height position is equal in all height positions, and the mixed gas supplied from the gas supply ports lower in height position has a higher dew point. In detail, the total gas flow rate from the gas supply ports 36A, 36B, and 36C and the total gas flow rate from the gas supply ports 38A, 38B, and 38C are equal, and the dew point of the mixed gas supplied from the gas supply ports 36A, 36B, and 36C is higher than the dew point of the mixed gas supplied from the gas supply ports 38A, 38B, and 38C in FIG. 2. For example, the dew point of the mixed gas supplied from the gas supply ports 36A, 36B, and 36C is adjusted to about −10° C. to +10° C., and the dew point of the mixed gas supplied from the gas supply ports 38A, 38B, and 38C is adjusted to about −10° C. to 5° C.

In another one of the disclosed embodiments, the dew point of the mixed gas supplied from each of the gas supply ports is equal, and the gas flow rate from the gas supply ports lower in height position is higher. In detail, the total gas flow rate from the gas supply ports 36A, 36B, and 36C is higher than the total gas flow rate from the gas supply ports 38A, 38B, and 38C in FIG. 2.

The gas in the annealing furnace 20 flows from downstream to upstream in the furnace, and is discharged from the steel strip introduction port in the lower part of the first heating zone 10A.

In the reducing annealing step in the soaking zone 12, an iron oxide formed in the surface of the steel strip in the oxidation step in the heating zone 10 is reduced, and an alloying element of Si or Mn forms an internal oxide inside the steel strip by oxygen supplied from the iron oxide. As a result, a reduced iron layer reduced from the iron oxide forms in the outermost surface of the steel strip, while Si or Mn remains inside the steel strip as an internal oxide. In this way, the oxidation of Si or Mn in the surface of the steel strip is suppressed and a decrease in wettability of the steel strip and hot-dip coating is prevented, as a result of which favorable coating adhesion is attained without non-coating.

Although favorable coating adhesion is attained in this way, a high alloying temperature in Si-containing steel may cause the decomposition of the retained austenite phase into the pearlite phase or the temper softening of the martensite phase, making it impossible to achieve desired mechanical properties. We accordingly studied a technique for lowering the alloying temperature, and discovered that, by further encouraging the internal oxidation of Si, the amount of solute Si in the surface layer of the steel strip can be reduced to facilitate the alloying reaction. An effective way to achieve this is to control the dew point of the atmosphere in the soaking zone 12 to −20° C. or more.

If the dew point in the soaking zone 12 is controlled to −20° C. or more, even after an internal oxide of Si forms by oxygen supplied from the iron oxide, the internal oxidation of Si continues by oxygen supplied from $H_2O$ in the atmosphere, so that more internal oxidation of Si takes place. As a result, the amount of solute Si decreases in the region inside the surface layer of the steel strip where the internal oxidation has occurred. When the amount of solute Si decreases, the surface layer of the steel strip behaves like low Si steel, and the subsequent alloying reaction is facilitated. The alloying reaction thus progresses at low temperature. As a result of lowering the alloying temperature, the retained austenite phase can be maintained at a high proportion, which contributes to improved ductility. Moreover, the temper softening of the martensite phase does not progress, and so desired strength is obtained. Since the steel substrate of the steel strip starts oxidizing when the dew point is +10° C. or more in the soaking zone 12, the upper limit of the dew point is preferably 0° C. in terms of the uniformity of the dew point distribution in the soaking zone 12 and the minimization of the dew point variation range.

The steel strip P subjected to annealing and hot-dip galvanizing is not particularly limited, but the advantageous effects can be effectively achieved in the case where the steel strip has a chemical composition in which Si content is 0.2 mass % or more.

EXAMPLES

Experimental Conditions

The continuous hot-dip galvanizing device illustrated in FIGS. 1 and 2 was used to anneal each steel strip whose chemical composition is shown in Table 1 under each annealing condition shown in Table 2, and then hot-dip galvanize and alloy the steel strip.

A DFF was used as the second heating zone. The heating burners were divided into four groups (#1 to #4) where the three groups (#1 to #3) upstream in the steel sheet traveling direction were made up of oxidizing burners and the last group (#4) was made up of reducing burners, and the air ratios of the oxidizing burners and reducing burners were set to the values shown in Table 2. The length of each group in the steel sheet traveling direction was 4 m.

A RT furnace having the volume Vr of 700 $m^3$ was used as the soaking zone. The average temperature in the soaking zone was set to the value shown in Table 2. As dry gas before humidification, gas (dew point: −50° C.) having a composition containing 15 vol % $H_2$ with the balance being $N_2$ and incidental impurities was used. Part of the dry gas was humidified by a humidifying device having a hollow fiber membrane-type humidifying portion, to prepare mixed gas. The hollow fiber membrane-type humidifying portion was made up of 10 membrane modules, in each of which dry gas of 500 L/min at the maximum and circulating water of 10 L/min at the maximum were flown. A common circulating constant-temperature water bath capable of supplying pure water of 100 L/min in total was used. Gas supply ports were arranged at the positions illustrated in FIG. 2. The gas flow rate and gas dew point from each of the lower three gas supply ports designated by reference sign 36 and the gas flow rate and gas dew point from each of the middle three gas supply ports designated by reference sign 38 in FIG. 2 are shown in Table 2. A lower dew point meter was located at a height of 2 m ($y_b$=2) from the furnace floor, an upper dew point meter at a height of 21 m ($y_a$=21) from the furnace floor, the lower gas supply ports at a height of 3 m ($y_i$=3) from the furnace floor, and the middle gas supply ports at a height of 9 m ($y_i$=9) from the furnace floor. The calculation result of Formula (1) for each of the lower three gas supply ports and the calculation result of Formula (1) for each of the middle three gas supply ports are also shown in Table 2.

The dry gas (dew point: −50° C.) was supplied to the first and second cooling zones with the flow rate shown in Table 2.

The temperature of the molten bath was set to 460° C., the Al concentration in the molten bath was set to 0.130%, and the coating weight was adjusted to 45 g/m$^2$ per surface by gas wiping. The line speed was set to 80 mpm to 100 mpm. After the hot-dip galvanizing, alloying treatment was performed in an induction heating-type alloying furnace so that the coating alloying degree (Fe content) was 10% to 13%. The alloying temperature in the treatment is shown in Table 2.

(Evaluation Method)

The evaluation of the coating appearance was conducted through inspection by an optical surface defect meter (detection of non-coating defects or overoxidation defects of 0.5 or more) and visual determination of alloying unevenness. Samples accepted on all criteria were rated "good", samples having a low degree of alloying unevenness were rated "fair", and samples rejected on at least one of the criteria were rated "poor". The length of alloying unevenness per 1000 m coil was also measured. The results are shown in Table 2.

In addition, the tensile strength of a galvannealed steel sheet produced under each condition was measured. Steel with steel sample ID A was accepted when the tensile strength was 590 MPa or more, steel with steel sample ID B was accepted when the tensile strength was 780 MPa or more, steel with steel sample ID C was accepted when the tensile strength was 980 MPa or more, and steel with steel sample ID D was accepted when the tensile strength was 1180 MPa or more. The results are shown in Table 2.

Further, the dew point in the soaking zone was measured at the positions illustrated in FIG. 2. The results are shown in Table 2.

(Evaluation Results)

As shown in Table 2, in Examples, the dew point was able to be stably controlled in the range of −10° C. to −20° C., and so the coating appearance was favorable and the tensile strength was high. Particularly in the case of charging mixed gas so as to satisfy Formula (1), the dew point was able to be more stably controlled in the range of −10° C. to −20° C., with the length of alloying unevenness being 0. In Comparative Examples in which mixed gas containing humidified gas was not supplied, on the other hand, moisture content was insufficient with only the moisture brought by the steel sheet, and the dew point in the soaking zone decreased with sheet passing. Thus, the dew point in the soaking zone was unable to be increased sufficiently, and also the dew point deviation in the furnace was high. As a result, alloying became uneven, and the alloying temperature increased and the tensile strength decreased. Besides, even Comparative Examples in which mixed gas containing humidified gas was supplied but the dew point in the upper part or the dew point in the lower part was unable to be controlled to −20° C. or more and 0° C. or less failed to achieve both favorable coating appearance and high tensile strength.

TABLE 1

| Steel ID | C | Si | Mn | P | (mass %) S |
|---|---|---|---|---|---|
| A | 0.08 | 0.25 | 1.5 | 0.03 | 0.001 |
| B | 0.12 | 1.4 | 1.9 | 0.01 | 0.001 |
| C | 0.11 | 1.5 | 2.7 | 0.01 | 0.001 |
| D | 0.15 | 2.1 | 2.8 | 0.01 | 0.001 |

TABLE 2

| | | Heating zone (DFF) | | | Soaking zone (RTF) | | | | | | | | |
|---|---|---|---|---|---|---|---|---|---|---|---|---|---|
| No. | Steel ID | Air ratio of oxidizing burner | Air ratio of reducing burner | Delivery temperature (° C.) | Dew point of upper part (° C.) | Dew point of lower part (° C.) | Average temperature (° C.) | Humidification | Gas flow rate of lower supply (Nm$^3$/hr) | Gas dew point of lower supply (° C.) | Gas flow rate of middle supply (Nm$^3$/hr) | Gas dew point of middle supply (° C.) | Left side of Formula (1) for lower supply |
| 1 | A | 0.95 | 0.85 | 681 | −30.5 | −40.7 | 801 | Not humidified | 150 | −50.0 | 150 | −50.0 | 138,606 |
| 2 | A | 0.95 | 0.85 | 681 | −16.3 | −19.7 | 802 | Humidified | 200 | 5.0 | 0 | — | 91,767 |
| 3 | A | 0.95 | 0.85 | 683 | −18.2 | −23.5 | 803 | Humidified | 150 | −12.0 | 150 | −12.0 | 136,793 |
| 4 | A | 0.95 | 0.85 | 682 | −14.7 | −16.5 | 805 | Humidified | 150 | 8.0 | 150 | 5.5 | 138,880 |
| 5 | A | 0.95 | 0.85 | 679 | −15.7 | −16.2 | 805 | Humidified | 160 | 5.0 | 140 | 5.0 | 140,427 |
| 6 | C | 1.15 | 0.85 | 711 | −14.2 | −15.5 | 821 | Humidified | 150 | 5.0 | 145 | 5.0 | 137,059 |
| 7 | C | 1.10 | 0.85 | 713 | −14.5 | −15.8 | 822 | Humidified | 150 | 4.5 | 150 | 2.0 | 139,417 |
| 8 | C | 1.10 | 0.85 | 710 | −15.3 | −24.2 | 820 | Humidified | 0 | — | 150 | 3.0 | — |
| 9 | C | 1.10 | 0.85 | 714 | −16.8 | −19.9 | 820 | Humidified | 150 | −10.0 | 150 | −8.0 | 138,028 |
| 10 | C | 1.10 | 0.85 | 711 | −16.5 | −19.2 | 819 | Humidified | 150 | −9.0 | 150 | −6.0 | 138,312 |
| 11 | D | 1.15 | 0.85 | 747 | −12.3 | −14.1 | 830 | Humidified | 150 | 5.0 | 145 | 5.0 | 136,163 |
| 12 | D | 1.20 | 0.85 | 751 | −11.1 | −12.9 | 831 | Humidified | 150 | 4.5 | 150 | 2.0 | 138,241 |
| 13 | B | 1.15 | 0.85 | 723 | −13.5 | −15.3 | 830 | Humidified | 150 | 3.0 | 150 | 1.0 | 138,683 |
| 14 | B | 1.10 | 0.85 | 721 | −13.4 | −15.9 | 830 | Humidified | 160 | 5.0 | 130 | 5.0 | 133,244 |
| 15 | B | 1.10 | 0.85 | 720 | 2.0 | −5.0 | 832 | Humidified | 150 | 11.0 | 150 | 11.0 | 118,835 |
| 16 | A | 0.95 | 0.85 | 678 | −15.1 | −17.8 | 801 | Humidified | 300 | 5.0 | 0 | — | 276,025 |
| 17 | A | 0.95 | 0.85 | 681 | −15.3 | −27.2 | 805 | Not humidified | 300 | −50.0 | 0 | — | 263,224 |
| 18 | C | 1.15 | 0.85 | 710 | −18.2 | −30.5 | 821 | Not humidified | 300 | −50.0 | 0 | — | 266,778 |
| 19 | C | 1.10 | 0.85 | 712 | −20.7 | −32.5 | 818 | Not humidified | 300 | −50.0 | 0 | — | 269,870 |
| 20 | D | 1.15 | 0.85 | 746 | −23.3 | −34.6 | 830 | Not humidified | 300 | −50.0 | 0 | — | 272,472 |

TABLE 2-continued

| | | | | | | | | | | | | | |
|---|---|---|---|---|---|---|---|---|---|---|---|---|---|
| 21 | D | 1.20 | 0.85 | 750 | −25.5 | −36.7 | 831 | Not humidified | 300 | −50.0 | 0 | — | 274,139 |
| 22 | B | 1.15 | 0.85 | 722 | −26.2 | −38.3 | 832 | Not humidified | 300 | −50.0 | 0 | — | 274,266 |
| 23 | B | 1.10 | 0.85 | 719 | −27.3 | −39.2 | 829 | Not humidified | 300 | −50.0 | 0 | — | 275,039 |

| | Soaking zone (RTF) | | | | | | | | | | | |
|---|---|---|---|---|---|---|---|---|---|---|---|---|
| No. | Middle side of Formula (1) for lower supply | Right side of Formula (1) for lower supply | Left side of Formula (1) for middle supply | Middle side of Formula (1) for middle supply | Right side of Formula (1) for middle supply | Determination on Formula (1) | Cooling zone Gas flow rate ($Nm^3$/hr) | Alloying treatment Alloying temperature (° C.) | Coating appearance | Length of alloying unevenness (m) | Tensile strength (MPa) | Category |
| 1 | 3,000 | 603,606 | 133,817 | 3,000 | 598,817 | Poor | 650 | 552 | Poor | 500 | 575 | Comparative Example |
| 2 | 573,975 | 401,767 | — | — | — | Poor | 650 | 515 | Fair | 20 | 615 | Example |
| 3 | 120,149 | 601,793 | 128,380 | 120,149 | 593,380 | Poor | 650 | 542 | Poor | 100 | 582 | Comparative Example |
| 4 | 529,402 | 603,880 | 134,639 | 445,739 | 599,639 | Good | 650 | 508 | Good | 0 | 622 | Example |
| 5 | 459,180 | 605,427 | 139,280 | 401,783 | 604,280 | Good | 650 | 508 | Good | 0 | 622 | Example |
| 6 | 430,481 | 594,309 | 133,876 | 416,132 | 591,126 | Good | 650 | 521 | Good | 0 | 1025 | Example |
| 7 | 415,686 | 604,417 | 136,251 | 348,233 | 601,251 | Good | 650 | 519 | Good | 0 | 1033 | Example |
| 8 | — | — | 58,830 | 373,956 | 291,330 | Poor | 650 | 562 | Poor | 300 | 965 | Comparative Example |
| 9 | 141,003 | 603,028 | 132,083 | 165,014 | 597,083 | Good | 650 | 540 | Fair | 20 | 981 | Example |
| 10 | 152,589 | 603,312 | 132,936 | 192,591 | 597,936 | Good | 650 | 529 | Good | 0 | 1007 | Example |
| 11 | 430,481 | 593,413 | 131,188 | 416,132 | 588,438 | Good | 650 | 523 | Good | 0 | 1260 | Example |
| 12 | 415,686 | 603,241 | 132,724 | 348,233 | 597,724 | Good | 650 | 521 | Good | 0 | 1233 | Example |
| 13 | 373,956 | 603,683 | 134,049 | 324,086 | 599,049 | Good | 650 | 515 | Good | 0 | 811 | Example |
| 14 | 459,180 | 582,744 | 127,132 | 373,084 | 576,632 | Good | 650 | 515 | Good | 0 | 809 | Example |
| 15 | 647,809 | 583,835 | 74,505 | 647,809 | 539,505 | Poor | 650 | 514 | Poor | 20 | 810 | Comparative Example |
| 16 | 860,963 | 1,206,025 | — | — | — | Good | 650 | 516 | Fair | 10 | 625 | Example |
| 17 | 5,999 | 1,193,224 | — | — | — | Poor | 650 | 546 | Poor | 200 | 592 | Comparative Example |
| 18 | 5,999 | 1,196,778 | — | — | — | Poor | 650 | 587 | Poor | 350 | 933 | Comparative Example |
| 19 | 5,999 | 1,199,870 | — | — | — | Poor | 650 | 591 | Poor | 500 | 928 | Comparative Example |
| 20 | 5,999 | 1,202,472 | — | — | — | Poor | 650 | 595 | Poor | 600 | 1140 | Comparative Example |
| 21 | 5,999 | 1,204,139 | — | — | — | Poor | 650 | 599 | Poor | 600 | 1101 | Comparative Example |
| 22 | 5,999 | 1,204,266 | — | — | — | Poor | 650 | 581 | Poor | 500 | 743 | Comparative Example |
| 23 | 5,999 | 1,205,039 | — | — | — | Poor | 650 | 583 | Poor | 500 | 738 | Comparative Example |

INDUSTRIAL APPLICABILITY

With the disclosed method of producing a galvannealed steel sheet, it is possible to obtain favorable coating appearance with high coating adhesion even in the case of galvannealing a steel strip whose Si content is 0.2 mass % or more, and prevent a decrease in tensile strength by lowering the alloying temperature.

REFERENCE SIGNS LIST

100 continuous hot-dip galvanizing device
10 heating zone
10A first heating zone (upstream)
10B second heating zone (downstream, direct fired furnace)
12 soaking zone
14 first cooling zone (rapid cooling zone)
16 second cooling zone (slow cooling zone)
18 snout
20 annealing furnace
22 hot-dip galvanizing bath
23 alloying line
24 gas distribution device
26 humidifying device
28 circulating constant-temperature water bath
30 gas mixing device
32 mixed gas dew point meter
34 mixed gas pipe
36A, 36B, 36C gas supply port
38A, 38B, 38C gas supply port
40A, 40B dew point measurement position
42 hearth roll
P steel strip

The invention claimed is:

1. A method of producing a galvannealed steel sheet using a continuous hot-dip galvanizing device that includes: an annealing furnace; a hot-dip galvanizing line; and an alloying line, the method comprising:

annealing a steel strip in the annealing furnace by conveying the steel strip through a heating zone comprising a direct fired furnace, a soaking zone, and a cooling zone in the stated order;

applying a hot-dip galvanized coating onto the steel strip discharged from the cooling zone, using the hot-dip galvanizing line; and heat-alloying the galvanized coating applied on the steel strip, using the alloying line, wherein a surface of the steel sheet is oxidized by the direct fired furnace, wherein gas humidified by a humidifying device and dry gas not humidified by the humidifying device are mixed at a predetermined mixture ratio to obtain at least one mixed gas, wherein the mixed gas is supplied into the soaking zone as reducing gas or non-oxidizing gas, wherein the mixed gas is supplied into the soaking zone from a plurality of gas supply ports located in a lower ½ of the soaking zone in a height direction and the gas supply ports are located at two or more different height positions, wherein the mixed gas has a dew point of more than −10° C. and less than +10° C., wherein a condition of supplying the mixed gas to the soaking zone satisfies the following Formula (1):

[Math. 1]

$$\left(2820 - \frac{m_a - m_b}{y_a - y_b} y_i\right)\frac{Vt}{N} \leq m_i V_i \leq \left(12120 - \frac{m_a - m_b}{y_a - y_b} y_i\right)\frac{Vt}{N} \quad (1)$$

where

"V" is a flow rate of the mixed gas in $m^3$/hr,

"m" is moisture content in the mixed gas calculated from a dew point of the mixed gas in ppm according to the following Formula (2):

[Math. 2]

$$m=6028.614\times10^{7.5T/(T+237.3)} \quad \ldots (2)$$

where

"T" is the dew point in ° C.,

"y" is a height position at which a dew point is measured or a height position of a gas supply port in meter, "N" is a total number of the gas supply ports, subscript "t" is total mixed gas, subscript "a" is a dew point measured in the upper ⅕ of the soaking zone in the height direction, subscript "b" is a dew point measured in the lower ⅕ of the soaking zone in the height direction, and subscript "i" is an ith gas supply port, and wherein a dew point measured in an upper ⅕ of the soaking zone in the height direction and a dew point measured in a lower ⅕ of the soaking zone in the height direction are both between −20° C. and 0° C.

2. The method of producing a galvannealed steel sheet according to claim 1, wherein a total gas flow rate from gas supply ports located at a same height position is equal for any height positions, wherein the at least one mixed gas is two or more mixed gas, and wherein the mixed gas supplied from a gas supply port lower in height position has a higher dew point than the mixed gas supplied from a gas supply port higher in height position.

3. The method of producing a galvannealed steel sheet according to claim 1, wherein a dew point of the mixed gas supplied from each of the gas supply ports is equal, and wherein a gas flow rate from a gas supply port lower in height position is higher than a gas flow rate from a gas supply port higher in height position.

4. The method of producing a galvannealed steel sheet according to claim 1, wherein an oxidizing burner and a reducing burner situated downstream of the oxidizing burner in a steel sheet traveling direction are provided in the direct fired furnace, and an air ratio of the oxidizing burner is adjusted to 0.95 or more and 1.5 or less, and an air ratio of the reducing burner is adjusted to 0.5 or more and less than 0.95.

* * * * *